United States Patent [19]

Wood

[11] 4,169,593

[45] Oct. 2, 1979

[54] BALLOON BURSTING GAME

[76] Inventor: Arthur R. Wood, P.O. Box 1676, Kingston, Ontario, Canada, K7K191

[21] Appl. No.: 905,149

[22] Filed: May 12, 1978

[51] Int. Cl.[2] ..... A63F 9/00

[52] U.S. Cl. ..... 273/1 R; 46/88; 273/138 R

[58] Field of Search ..... 273/1 R, 138 R; 46/88

[56] References Cited

U.S. PATENT DOCUMENTS

| | | | |
|---|---|---|---|
| 3,357,128 | 12/1967 | Geiser | 46/88 X |
| 3,608,903 | 9/1971 | Cooper | 273/1 R |
| 3,685,825 | 8/1972 | Dorazio | 273/1 R |
| 3,795,400 | 3/1974 | Glass et al. | 46/88 X |

*Primary Examiner*—Anton O. Oechsle

*Attorney, Agent, or Firm*—Daniel Jay Tick

[57] ABSTRACT

An inflated balloon is positioned in a chamber having a top with a hole formed therethrough. An elastic partition is supported above the chamber and has a plurality of needles affixed thereto and extending perpendicularly therefrom into the hole. A partition with a plurality of mutually spaced holes formed therethrough is positioned above the elastic partition. A plurality of marbles are dropped by the players through the holes of the partition having the holes therethrough so that when a sufficient number of marbles rest on the elastic partition, the weight thereon stretches the center area of the elastic partition downward sufficiently to force a needle thereof through the hole in the top of the chamber into the balloon thereby bursting the balloon.

1 Claim, 6 Drawing Figures

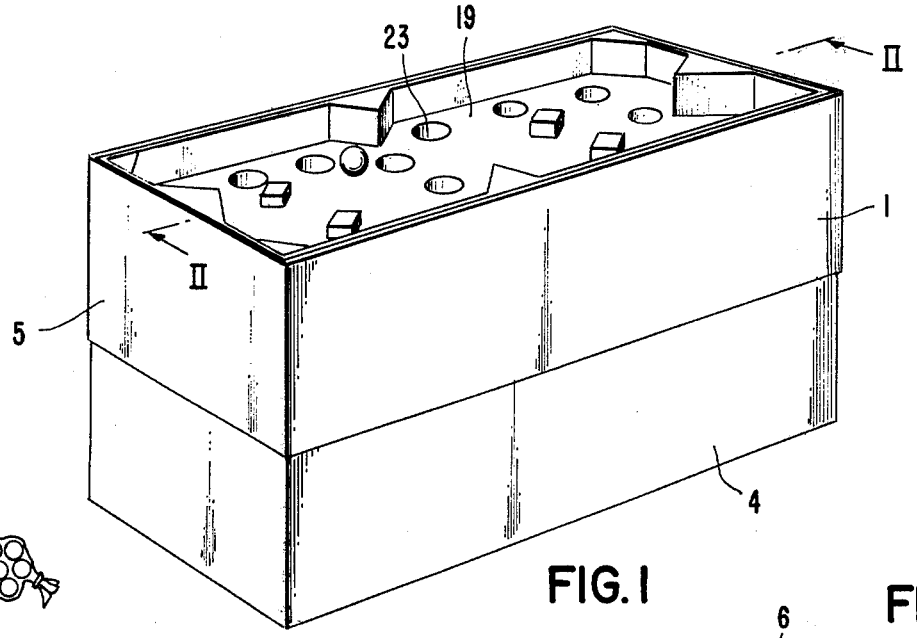
FIG. 1
FIG. 5
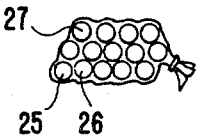
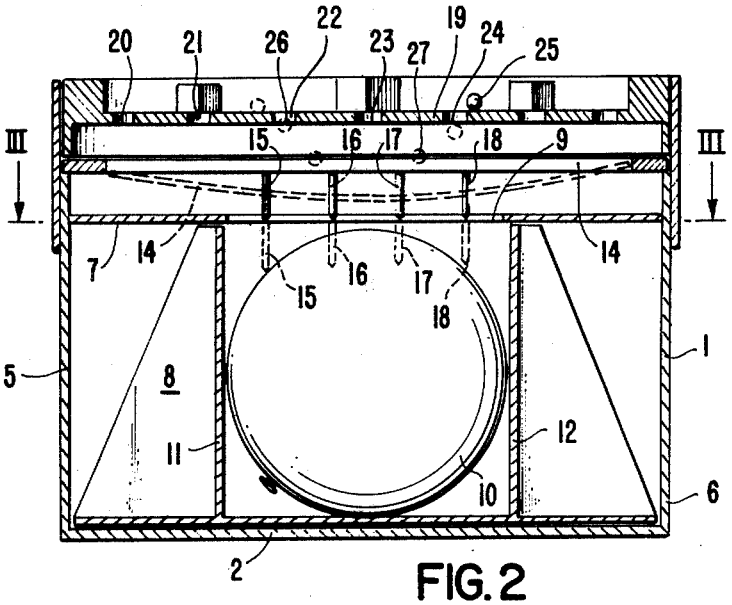
FIG. 2
FIG. 3
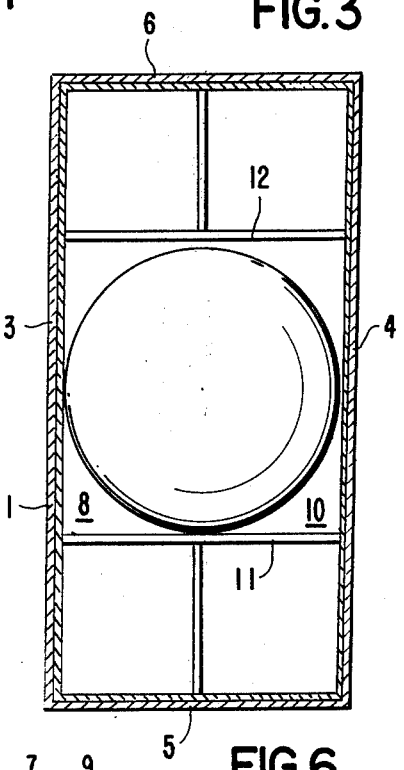
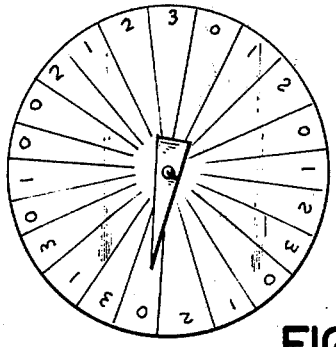
FIG. 4
FIG. 6
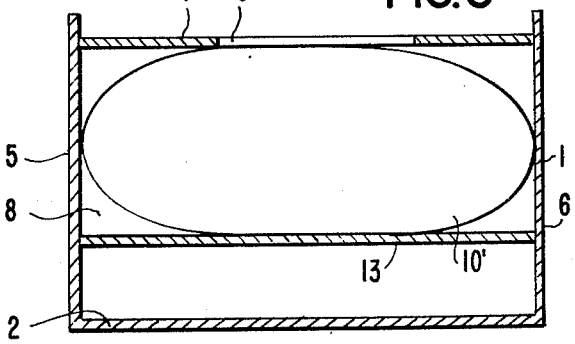

BALLOON BURSTING GAME

BACKGROUND OF THE INVENTION

The present invention relates to a game.

Games of the type described herein are disclosed in the following United States patents. U.S. Pat. No. 3,608,903, issued Sept. 28, 1971 to Cooper et al, U.S. Pat. No. 3,638,945, issued Feb. 1, 1972 to Breslow, U.S. Pat. No. 3,685,825, issued Aug. 22, 1972 to Dorazio, U.S. Pat. No. 3,712,621, issued Jan. 23, 1973 to Ames, U.S. Pat. No. 3,795,400, issued Mar. 5, 1974 to Glass et al and U.S. Pat. No. 3,861,684, issued Jan. 21, 1975 to Gasten et al.

Objects of the invention are to provide a game of simple structure, which is inexpensive in manufacture, and provides amusement and interest for children.

BRIEF DESCRIPTION OF THE DRAWINGS

In order that the invention may be readily carried into effect, it will now be described with reference to the accompanying drawings, wherein:

FIG. 1 is a perspective view of an embodiment of the game of the invention;

FIG. 2 is a sectional view, on an enlarged scale, taken along the lines II—II, of FIG. 1;

FIG. 3 is a cross-sectional view, taken along the lines III—III, of FIG. 2;

FIG. 4 is a view of a spindle utilized with the game of the invention;

FIG. 5 is a perspective view of a bag of marbles utilized with the game of the invention; and FIG. 6 is a cross-sectional view, on a reduced scale, of a modification of the partitions of the container to accommodate an oblong balloon rather than a round baloon.

DETAILED DESCRIPTION OF THE INVENTION

The game of the invention comprises a container 1 (FIGS. 1 to 3 and 6) of substantially rectangular parallelepiped configuration having a bottom 2 (FIGS. 2 and 6), a first pair of spaced substantially parallel sides 3 and 4 (FIG. 3) substantially perpendicular to the bottom 2, and a second pair of spaced substantially parallel sides 5 and 6 (FIGS. 2, 3 and 6) substantially perpendicular to the bottom 2 and to the first pair of sides 3 and 4.

A first partition 7 in the container 1, shown in FIGS. 2 and 6, extends between the sides 3, 4, 5 and 6 thereof and is spaced from, and substantially parallel to, the bottom 2, and forms a chamber 8 (FIGS. 2, 3 and 6). The first partition 7 has a hole 9 formed therethrough in the area of the center thereof, as shown in FIGS. 2 and 6.

An inflated balloon 10 (FIGS. 2 and 3) or 10' (FIG. 6) is provided in the chamber 8. When the balloon is substantially spherical in configuration, as is the balloon 10, shown in FIGS. 2 and 3, the chamber 8 is partitioned by ancillary partitions 11 and 12 to form a substantially cubic area in which the balloon is directly accommodated beneath the hole 9. When the balloon is oblong or elongated, as is the balloon 10', shown in FIG. 6, the chamber is provided with ancillary bottom partition 13 (FIG. 6) in order to support said balloon close to the first partition 7.

A substantially elastic second partition 14 (FIG. 2) of any suitable type such as, for example, rubber or rubberized material having the desired elasticity, is provided in the container 1 extending between the sides 3, 4, 5 and 6 thereof above the first partition 7 and spaced from, and substantially parallel to, said first partition.

A plurality of needles 15, 16, 17 and 18 are affixed to the second partition 14 and extend substantially perpendicularly therefrom into the hole 9 of the first partition 7, as shown in FIG. 2.

A third partition 19 (FIGS. 1 and 2) is provided in the container 1 extending between the sides 3, 4, 5 and 6 thereof above the second partition 14, and spaced from, and substantially parallel to, said second partition. The third partition 19 has a plurality of mutually spaced holes 20, 21, 22, 23, 24, and so on, formed therethrough of sufficient diameter to pass marbles (FIG. 2).

A plurality of marbles 25, 26, 27, and so on (FIGS. 2 and 5) are dropped by the players through the holes 20 to 24, and so on, through the third partition 19. Thus, when a sufficient number of marbles rest on the second partition 14, the weight thereof stretches the center area of said second partition downward, as shown by broken lines in FIG. 2, sufficiently to force a needle thereof through the hole 9 through the first partition 7 into the balloon 10 or 10', as shown by broken lines in FIG. 2, thereby bursting the balloon, to the considerable amusement of the children playing the game.

The spindle of FIG. 4 is utilized by each of the players to determine with how many marbles he or she may play the game.

While the invention has been described by means of a specific example and in a specific embodiment, I do not wish to be limited thereto, for obvious modifications will occur to those skilled in the art without departing from the spirit and scope of the invention.

I claim:

1. A game, comprising a container of substantially rectangular parallelepiped configuration having a bottom, a first pair of spaced substantially parallel sides substantially perpendicular to the bottom and a second pair of spaced substantially parallel sides substantially perpendicular to the bottom and to the first pair of sides;

a first partition in the container extending between the sides thereof spaced from and substantially parellel to the bottom and forming a chamber, said first partition having a hole formed therethrough in the area of the center thereof;

an inflated balloon in the chamber;

a substantially elastic second partition in the container extending between the sides thereof above the first partition and spaced from and substantially parallel to said first partition;

a plurality of needles affixed to said second partition and extending substantially perpendicularly therefrom into the hole of said first partition;

a third partition in the container extending between the sides thereof above said second partition and spaced from and substantially parallel to said second partition, said third partition having a plurality of mutually spaced holes formed therethrough of sufficient diameter to pass marbles; and a plurality of marbles dropped by players through the holes through the third partition whereby when a sufficient number of marbles rest on said second partition the weight thereof stretches the center area of said partition downward sufficiently to force a needle thereof through the hole through said first partition into said balloon thereby bursting said balloon.

* * * * *